US005545948A

United States Patent [19]

Mii

[11] Patent Number: 5,545,948

[45] Date of Patent: Aug. 13, 1996

[54] GLASS TUBE LAMP MATRIX DEVICE

[75] Inventor: Adam Mii, Taipei City, Taiwan

[73] Assignee: Chilong Data Products Corp., Taipei City, Taiwan

[21] Appl. No.: 303,180

[22] Filed: Sep. 8, 1994

[51] Int. Cl.[6] ..... H01J 61/30

[52] U.S. Cl. ..... 313/634; 313/493; 313/582; 313/643; 362/216; 362/225; 362/263; 362/260

[58] Field of Search ..... 313/634, 643, 313/493, 581, 582; 362/216, 225, 263, 217, 260, 242, 243, 230, 231, 293, 249; 220/2.1 R

[56] References Cited

U.S. PATENT DOCUMENTS 2,822,496 2/1958 Maurer ..... 313/581

*Primary Examiner*—Sandra L. O'Shea
*Assistant Examiner*—Matthew J. Esserman
*Attorney, Agent, or Firm*—Jones & Askew

[57] ABSTRACT

A glass tube lamp matrix device includes a working gas container set and a glass tube matrix. The working gas container set includes a plurality of parallel first elongated containers in a plane and a plurality of parallel second elongated containers crossing the first elongated containers in a plane and forming an angle therewith. Each of the first and second elongated containers contains a working gas therein. The glass tube matrix includes a plurality of thin glass tubes, each of which having two open ends which are fluidly and respectively communicated with one of the first elongated containers and one of the second elongated containers, thereby filling the glass tubes with the working gas. Each of the glass tubes has a cross-sectional area much smaller than that of the first and second elongated containers. The working gas in a particular glass tube discharges so as to emit light when a sufficient voltage drop is applied to electrodes provided in the first and second elongated containers corresponding to the particular glass tube. Due to the large working gas capacity of the container set, a longer useful life and lower maintenance costs can be achieved.

7 Claims, 3 Drawing Sheets

GLASS TUBE LAMP MATRIX DEVICE

BACKGROUND OF THE INVENTION

1. Field of the Invention

The invention relates to a gas-discharge lamp, more particularly to a glass tube lamp matrix device which has a longer useful life when compared to conventional gas-discharge lamps.

2. Description of the Related Art

Referring to FIG. 1, a conventional neon lamp 10 is shown to comprise a thin, generally U-shaped glass tube 12 and a pair of electrodes 14 disposed respectively at two sealed ends of the latter. The glass tube 12 is vacuumed before filling the same with an appropriate working gas, such as neon, in order to enable the lamp 10 to generate colored light when a predetermined voltage drop is applied between the electrodes 14. The electrodes 14 are connected to an external power source (not shown) by means of wires 140.

Some of the drawbacks of the conventional neon lamp 10 are as follows:

1. Because of the difficulty and high costs involved in vacuuming the glass tube 12 to near perfect levels, small amounts of impurities and other gases are usually retained in the tube 12. After prolonged use of the lamp 10 at high operating temperatures, a chemical reaction between the impurities inside the glass tube 12 and the electrodes 14 will occur, thereby resulting in corrosion and in a reduction in the amount of working gas. Sooner or later, because of an insufficient amount of remaining working gas, the lamp 10 would be useless due to its failure to emit sufficient light, thus resulting in a relatively short useful life for the lamp 10.

2. The glass tube 12 has an inner wall surface which is provided with a fluorescent substance layer. The conventional lamp 10 is similarly thrown away when the fluorescent substance layer fades due to prolonged use.

3. Too many accessories are required when the neon lamp 10 is installed in a lamp matrix used for advertising purposes, thereby resulting in a complicated assembly process and in higher costs for manufacturing the lamp matrix.

SUMMARY OF THE INVENTION

Therefore, the main objective of the present invention is to provide a glass tube lamp matrix device which has a longer useful life when compared to conventional gas-discharge lamps.

Another objective of the present invention is to provide a glass tube lamp matrix device which is easy to assemble, thereby resulting in reduced manufacturing costs.

Accordingly, a glass tube lamp matrix device of the present invention comprises: a first set of working gas containers including a plurality of parallel first elongated containers in a plane and a plurality of parallel second elongated containers crossing the first elongated containers in a plane and forming an angle therewith, each of the first and second elongated containers containing a working gas therein; a first glass tube matrix including a plurality of thin glass tubes, each of the glass tubes having two open ends which are fluidly and respectively communicated with one of the first elongated containers and one of the second elongated containers, thereby filling each of the glass tubes with the working gas, each of the glass tubes having a cross-sectional area much smaller than that of the first and second elongated containers; and an electrode provided in each of the first and second elongated containers. The working gas in the glass tubes discharge so as to emit light when a sufficient voltage drop is applied to the electrodes in the first and second containers corresponding to the glass tubes.

The glass tube lamp matrix device may further comprise cap units which not only serve to cover the glass tubes but also serve to vary the color of the light emitted from the glass tubes, and spare working gas tanks which are to be connected fluidly to the working gas containers so as to supply additional working gas to the lamp matrix device when needed. Due to the large working gas capacity of the glass tube lamp matrix device of the present invention, a longer useful life can be achieved.

The glass tube lamp matrix device may additionally comprise: a second set of working gas containers including a plurality of parallel third elongated containers, each of which being interposed between two adjacent ones of the first elongated containers, and a plurality of parallel fourth elongated containers, each of which being interposed between two adjacent ones of the second elongated containers; a second glass tube matrix interleaving the first glass tube matrix and including a plurality of thin glass tubes, each of the glass tubes of the second glass tube matrix having two open ends which are fluidly and respectively communicated with one of the third elongated containers and one of the fourth elongated containers, each of the glass tubes of the second glass tube matrix having a cross-sectional area much smaller than that of the third and fourth elongated containers; and an electrode provided in each of the third and fourth elongated containers. Each of the third and fourth elongated containers contains a working gas that is capable of emitting light which differs in color from that emitted from the glass tubes of the first glass tube matrix when discharging.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
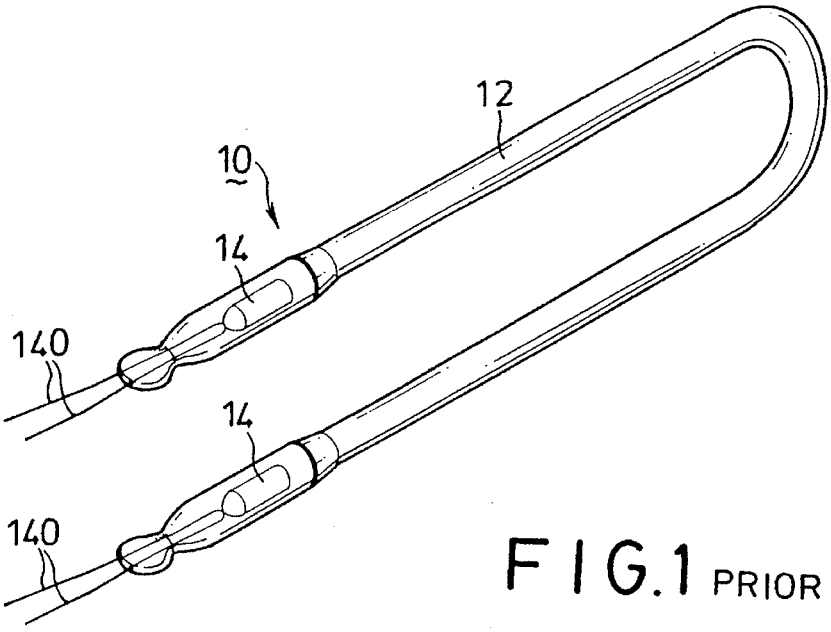
FIG.1 PRIOR ART
FIG. 1 is a perspective view showing a conventional neon lamp.

Before the present invention is described in greater detail, it should be noted that like elements are indicated by the same reference numerals throughout the remaining disclosure.

Figure 2:
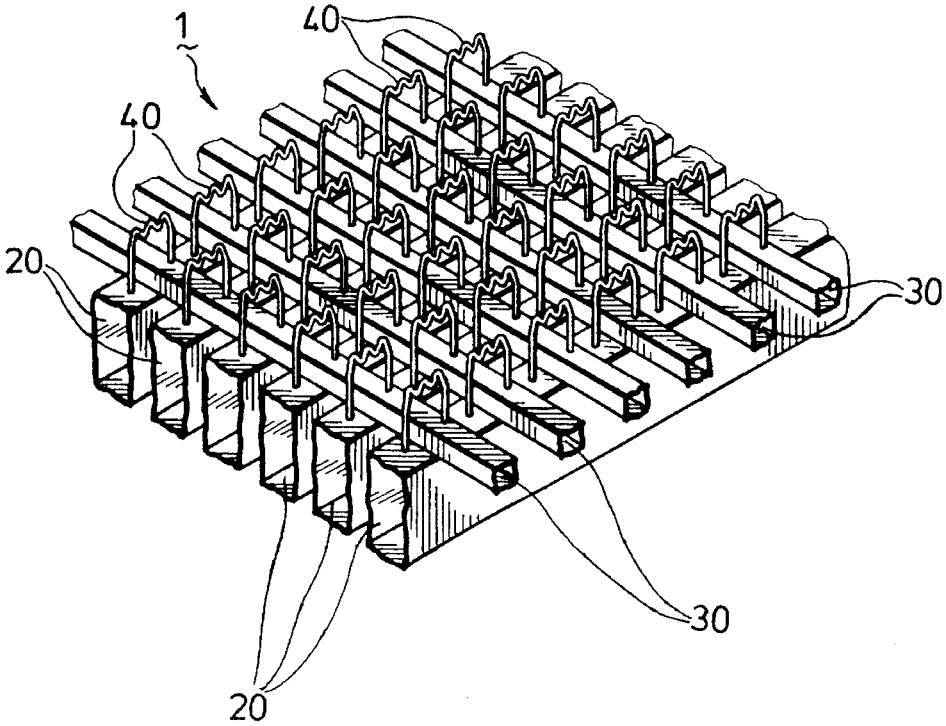
FIG. 2 is a fragmentary perspective view showing the first preferred embodiment of a glass tube lamp matrix device according to the present invention.
Figure 3:
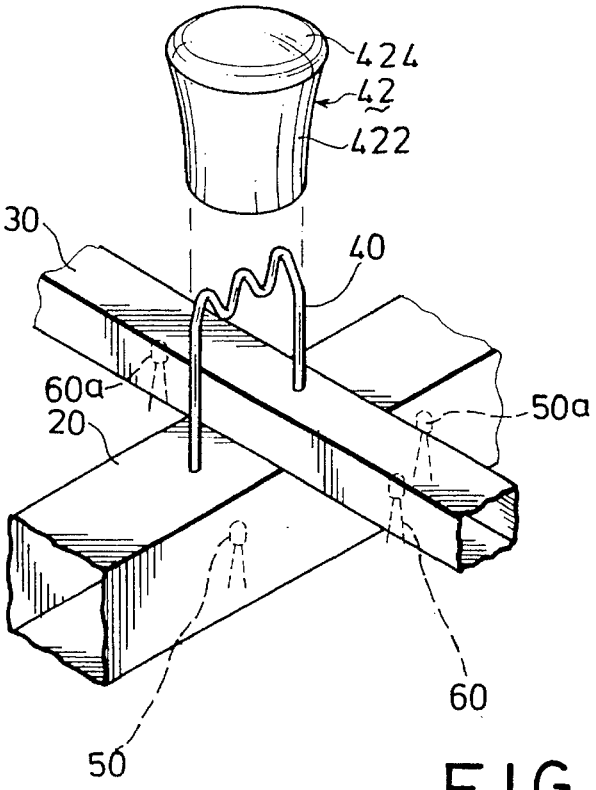
FIG. 3 is a fragmentary perspective view showing a single lamp unit of the first preferred embodiment.

Referring to FIGS. 2 and 3, the first preferred embodiment of a glass tube lamp matrix device according to the present invention is shown to comprise a set of working gas containers and a plurality of glass tubes 40 arranged in a matrix. The working gas container set includes a plurality of parallel first elongated sealed containers 20 and a plurality of parallel second elongated sealed containers 30 which cross the first elongated containers 20 on a plane and which form an angle therewith. In this embodiment, the first and second elongated containers 30 are transverse to each other and contain a working gas, such as neon, argon, mercury, etc., that is capable of emitting radiant energy when discharging. The cross-section of the working gas containers 20, 30 may be rounded, oval or rectangular, as shown in this figure.

The glass tubes 40 are thin tubes which may be spiral-shaped or generally U-shaped, as shown in this embodiment. Each of the glass tubes 40 has two open ends which extend sealingly and respectively into one of the first elongated containers 20 and one of the second elongated containers 30, thereby fluidly and respectively communicating the glass tubes 40 with the latter to fill each of the glass tubes 40 with the working gas, as shown in FIG. 3. The contour of the glass tube 40 is designed according to the intended environment. A longer contour is preferred to increase the light emitting area, thereby attaining better luminosity.

Each of the glass tubes 40 has a cross-sectional area much smaller than that of the first and second elongated containers 20, 30. The cross-sectional area of the working gas containers 20, 30 may be enlarged according to the need of increasing the volume of the working gas. Preferably, the cross-sectional area of each of the working gas containers 20, 30 is much larger than the sum of the cross-sectional area of all of the glass tubes 40 connected thereto.

Each of the first and second containers 20, 30 further has an electrode 50, 60 provided therein. The electrodes 50, 60 are to be Coupled to an external power source (not shown). Because each of the first and second elongated containers 20, 30 has a cross-sectional area much larger than that of the glass tubes 40, the working gas in the containers 20, 30 do not emit light when the external power source (not shown) is operated so as to supply power to the electrodes 50, 60. Instead, the working gas in the glass tubes 40 discharge so as to emit light due to the presence of a relatively high voltage per unit volume when a sufficient voltage drop is applied to the electrodes 50, 60 in the first and second elongated containers 20, 30 corresponding to the glass tubes 40.

Spare electrodes 50*a*, 60*a* may be installed within each of the first and second elongated containers 20, 30 so that the glass tube lamp matrix device is still operable even though the electrodes 50, 60 are already unusable due to a long period of use, thereby resulting in a longer useful life. It is noted that dc or ac voltage may be applied to the electrodes 50, 60. Thus, bidirectional scanning using alternating current is possible when the glass tube lamp matrix device is in use.

Figure 4:
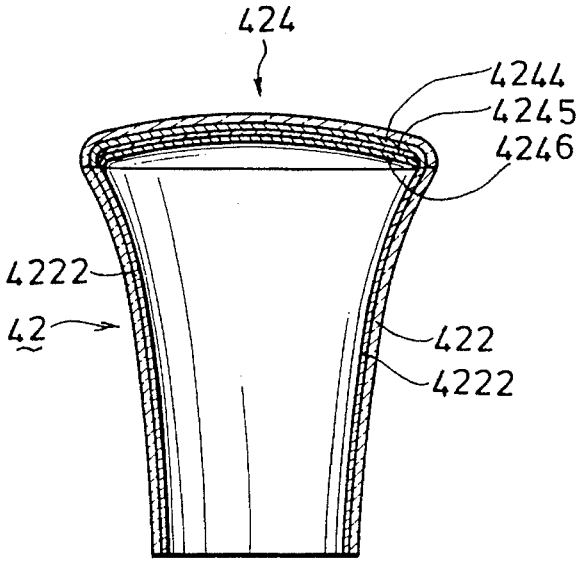
FIG. 4 is a sectional view showing a cap unit of the first preferred embodiment.

The glass tube 40 is preferably made of fused quartz glass, which is known for its superior ultraviolet light emission properties. The glass tube lamp matrix device further comprises a plurality of cap units 42 for covering respectively the glass tubes 40 so as to protect the latter. Referring to FIGS. 3 and 4, each cap unit 42 comprises a top cover 424 and a surrounding shell 422 which extends from a periphery of the top Dover 424 and which has an inner wall surface with a reflective coating 4222 thereon. Thus, the surrounding shell 422 is capable of reflecting most of the light emitted by the working gas in the glass tube 40 to the top cover 424. The top cover 424 is made of flint glass and has an inner wall surface which is provided with a bandpass color filter layer 4244, a glass layer 4245 on the filter layer 4244, and a fluorescent substance layer 4246 coated on the glass layer 4245. The fluorescent substance layer 4246 receives ultraviolet light and produces colored light therefrom. The filter layer 4244 filters and refines the colored light from the fluorescent substance layer 4246, thus passing only the light which has the desired color. The glass layer 4245 filters out harmful ultraviolet rays to prevent the filter layer 4244 from fading.

Note that in this embodiment, the first and second elongated containers 20, 30 contain the same working gas. Thus, although the glass tubes 40 emit light of the same color when the first preferred embodiment is in use, the glass tube lamp matrix device is still capable of generating different colors of light by choosing properly the chemicals used for the filter layer 4244 and the fluorescent substance layer 4246 of the cap units 42. When viewed from afar, the different colors generated by the glass tube lamp matrix device appear to be mixed so as to permit the generation of an unlimited number of colors.

The top cover 424 can be mounted removably on the surrounding shell 422 in a known manner, thereby permitting its replacement when the fluorescent substance layer 4246 fades.

Figure 5:
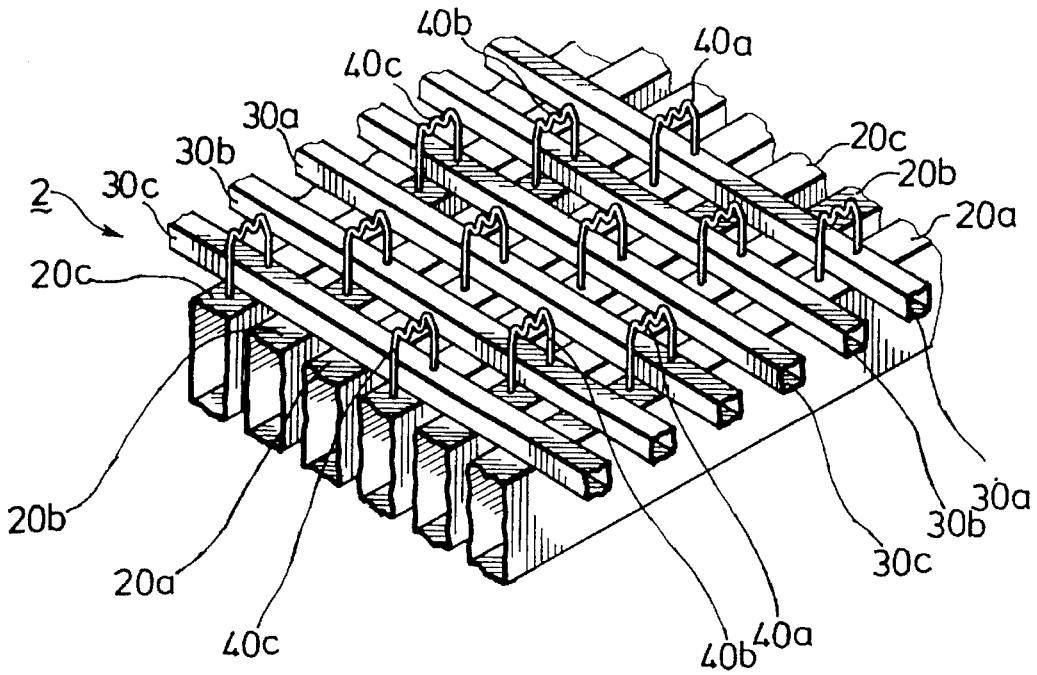
FIG. 5 is a fragmentary perspective view of the second preferred embodiment of a glass tube lamp matrix device according to the present invention.
Figure 6:
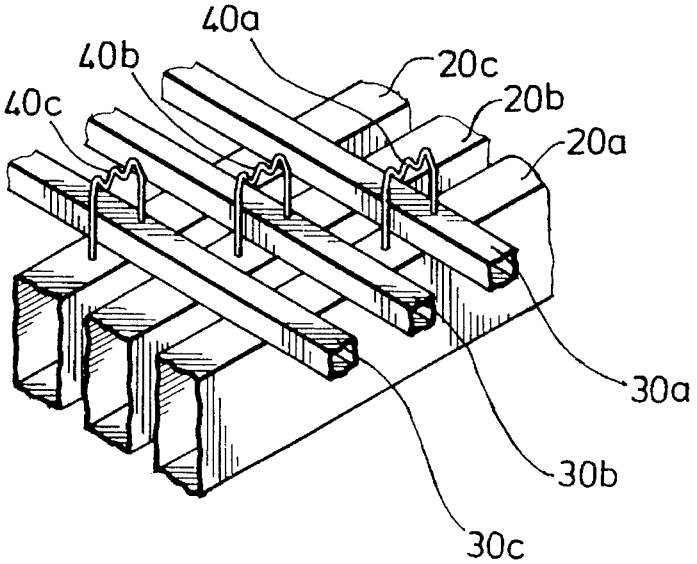
FIG. 6 is a fragmentary perspective view which illustrates a portion of the second preferred embodiment.

Referring to FIGS. 5 and 6, the second preferred embodiment of a glass tube lamp matrix device according to the present invention is shown to comprise interleaved first, second and third sets of working gas containers and first, second and third glass tube matrices.

The first set of working gas containers includes a plurality of parallel first elongated sealed containers 20*a* and a plurality of parallel second elongated sealed containers 30*a* transverse to the first elongated containers 20*a*. The first glass tube matrix includes a plurality of thin glass tubes 40*a*, each of which having two open ends that are fluidly and respectively communicated with one of the first elongated containers 20*a* and one of the second elongated containers 30*a*, thereby filling each of the glass tubes 40*a* with a first working gas that emits a colored light output when discharging.

The second set of working gas containers includes a plurality of parallel third elongated sealed containers 20*b* and a plurality of parallel fourth elongated sealed containers 30*b* transverse to the third elongated containers 20*b*. Each of the third elongated containers 20*b* is parallel to and flanked by one of the first elongated containers 20*a*, while each of the fourth elongated containers 30*b* is parallel to and flanked by one of the second elongated containers 30*a*. The second glass tube matrix interleaves the first glass tube matrix and includes a plurality of thin glass tubes 40*b*, each of which having two open ends that are fluidly and respectively communicated with one of the third elongated containers 20*b* and one of the fourth elongated containers 30*b* so as to fill each of the glass tubes 40*b* with a second working gas that emits light which differs in color from that emitted by the first working gas when discharging.

The third set of working gas containers includes a plurality of parallel fifth elongated sealed containers 20*c* and a plurality of parallel sixth elongated sealed containers 30*c* transverse to the fifth elongated containers 20*c*. Each of the fifth elongated containers 20*c* is parallel to and interposed between adjacent ones of the first and third elongated containers 20*a*, 20*b*, while each of the sixth elongated containers 30*c* is parallel to and interposed between adjacent ones of the second and fourth elongated containers 30*a*, 30*b*. The third glass tube matrix interleaves the first and second glass tube matrices and includes a plurality of thin glass tubes 40*c*, each of which having two open ends that are fluidly and respectively communicated with one of the fifth elongated containers 20*c* and one of the sixth elongated containers 30*c* so as to fill each of the glass tubes 40*c* with a third working gas that emits light which differs in color from that emitted by the first and second working gas when discharging.

It is noted that the first, second and third working gases may be selected so as to emit different colors, such as red, blue, etc. As with the previous embodiment, each of the glass tubes 40*a*, 40*b*, 40*c* may be provided with a respective cap unit (not shown) to cover the same, thereby further broadening the range of colors that may be generated by the glass tube lamp matrix device of the present invention. In addition, the number of working gas container sets and the number of glass tube matrices may be varied in accordance with the installation requirements.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A glass tube lamp matrix device, comprising:

a first set of working gas containers including a plurality of parallel first elongated containers in a plane and a plurality of parallel second elongated containers crossing said first elongated containers in a plane and forming an angle therewith, each of said first and second elongated containers containing a working gas therein;

a first glass tube matrix including a plurality of thin glass tubes, each of said glass tubes having two open ends which are fluidly and respectively communicated with one of said first elongated containers and one of said second elongated containers, thereby filling each of said glass tubes with said working gas, each of said glass tubes having a cross-sectional area much smaller than that of said first and second elongated containers; and an electrode provided in each of said first and second elongated containers;

whereby, said working gas in said glass tubes discharge so as to emit light when a sufficient voltage drop is applied to said electrodes in said first and second elongated containers corresponding to said glass tubes.

2. The glass tube lamp matrix device as claimed in claim 1, further comprising a plurality of cap units for covering respectively said glass tubes.

3. The glass tube lamp matrix device as claimed in claim 2, wherein each of said cap units comprises a top cover and a surrounding shell which extends from a periphery of said top cover and which has an inner wall surface with a reflective coating thereon.

4. The glass tube lamp matrix device as claimed in claim 3, wherein said top cover is made of glass and has an inner wall surface which is provided with a bandpass color filter layer, a glass layer on said filter layer, and a fluorescent substance layer coated on said glass layer.

5. The glass tube lamp matrix device as claimed in claim 1, wherein the cross-sectional area of each of said first and second elongated containers is much larger than the sum of the cross-sectional area of all of said glass tubes connected thereto.

6. The glass tube lamp matrix device as claimed in claim 1, further comprising a spare electrode provided in each of said first and second elongated containers.

7. The glass tube lamp matrix device as claimed in claim 1, further comprising:

a second set of working gas containers including a plurality of parallel third elongated containers, each of which being interposed between two adjacent ones of said first elongated containers, and a plurality of parallel fourth elongated containers, each of which being interposed between two adjacent ones of said second elongated containers;

a second glass tube matrix interleaving said first glass tube matrix and including a plurality of thin glass tubes, each of said glass tubes of said second glass tube matrix having two open ends which are fluidly and respectively communicated with one of said third elongated containers and one of said fourth elongated containers, each of said glass tubes of said second glass tube matrix having a cross-sectional area much smaller than that of said third and fourth elongated containers; and an electrode provided in each of said third and fourth elongated containers;

each of said third and fourth elongated containers filled with another working gas that is capable of emitting light which differs in color from that emitted by said working gas in said glass tubes of said first glass tube matrix when discharging.

* * * * *